US010294617B1

(12) United States Patent
McCarthy

(10) Patent No.: US 10,294,617 B1
(45) Date of Patent: May 21, 2019

(54) PACKAGING FOR DRIVEWAY SEALERS AND REPAIR MATERIALS

(71) Applicant: Matthew D McCarthy, Parma Heights, OH (US)

(72) Inventor: Matthew D McCarthy, Parma Heights, OH (US)

( * ) Notice: Subject to any disclaimer, the term of this patent is extended or adjusted under 35 U.S.C. 154(b) by 0 days.

(21) Appl. No.: 15/696,378

(22) Filed: Sep. 6, 2017

Related U.S. Application Data

(60) Provisional application No. 62/383,656, filed on Sep. 6, 2016, provisional application No. 62/409,396, filed on Oct. 18, 2016.

(51) Int. Cl.
*E01C 19/12* (2006.01)
*B65D 85/00* (2006.01)

(52) U.S. Cl.
CPC ..... *E01C 19/12* (2013.01); *B65D 85/70* (2013.01)

(58) Field of Classification Search
CPC ..... E01C 19/12; E01C 23/14; B65D 5/445; B65D 5/563
See application file for complete search history.

(56) References Cited

U.S. PATENT DOCUMENTS 2,864,360 A * 12/1958 Love ..... E01C 23/14 126/271.2 R
2,988,207 A * 6/1961 Lovelace ..... B65D 81/3272 206/568
3,819,107 A * 6/1974 Ryder, Jr. ..... B65D 63/1027 206/219
4,265,559 A * 5/1981 Mellen ..... E04D 15/07 401/137
4,831,958 A * 5/1989 Selby ..... E01C 23/0973 118/108
5,733,616 A * 3/1998 Janicki ..... B65B 63/08 206/447
5,765,686 A * 6/1998 Wright ..... B65D 1/22 206/447
6,102,615 A * 8/2000 Wilson, Sr. ..... E01C 19/16 118/108
6,279,838 B1 * 8/2001 Sivells ..... A01G 25/09 239/146
6,290,428 B1 * 9/2001 Hall ..... E01C 23/096 15/103.5
6,962,455 B2 * 11/2005 Kugler ..... E04D 15/06 222/626
6,966,723 B2 * 11/2005 Zentner ..... E01C 11/005 404/17
7,513,444 B1 * 4/2009 Kurimski ..... E04D 15/07 215/286
8,251,603 B2 * 8/2012 Kott ..... A46B 9/005 118/207

(Continued)

*Primary Examiner* — Abigail A Risic
(74) *Attorney, Agent, or Firm* — John D. Gugliotts

(57) ABSTRACT

An asphalt sealer packaging and dispensing system having a pre-portioned, modular containment for containing a volume of cold pour asphalt sealer. The modular containment is formed of a cube shaped outer corrugated cardboard housing having a high temperature stable sealing insert. The housing is interchangeably attached to a spreading apparatus having a wheeled carriage with grasping/pushing handles. A linear output of asphalt sealer is thereby dispensed as said wheeled carriage is rolled along a target surface.

16 Claims, 6 Drawing Sheets

(56) References Cited

U.S. PATENT DOCUMENTS

| | | | | |
|---|---|---|---|---|
| 8,696,238 | B2 * | 4/2014 | Rogan | E01C 19/172 404/101 |
| 2003/0129011 | A1 * | 7/2003 | Kugler | E04D 15/06 401/48 |
| 2004/0033383 | A1 * | 2/2004 | Zentner | E01C 11/005 428/543 |
| 2004/0112906 | A1 * | 6/2004 | von Holdt, Jr. | B65D 21/0233 220/657 |
| 2007/0104537 | A1 * | 5/2007 | Becker | E01C 19/17 404/75 |
| 2011/0081479 | A1 * | 4/2011 | Morris, Jr. | B05B 1/28 427/136 |
| 2014/0248082 | A1 * | 9/2014 | Findley | E01C 11/005 404/79 |
| 2015/0082748 | A1 * | 3/2015 | Draper | B65D 5/061 53/401 |
| 2017/0225857 | A1 * | 8/2017 | Splinter | B65D 65/38 |

* cited by examiner

CUBE-SHAPED
CORRUGATED CARDBOARD
WITH PERFORATED HAND-HOLDS & SPOUT COVER

ELONGATED FLAPS (TOP & BOTTOM) FOR STRENGTH

HIGH TEMP STABLE, POLY BAG INSERTS FOR SEALANT
BLOW MOLDED INSERT
FIG. 7
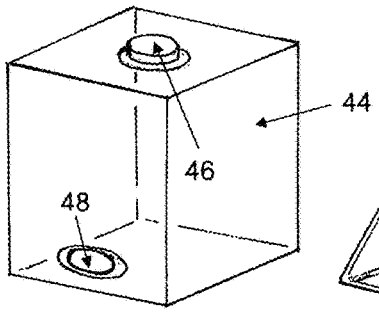
FIG. 8
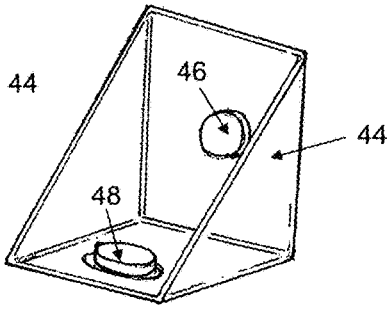
GUSSETED BAG INSERT
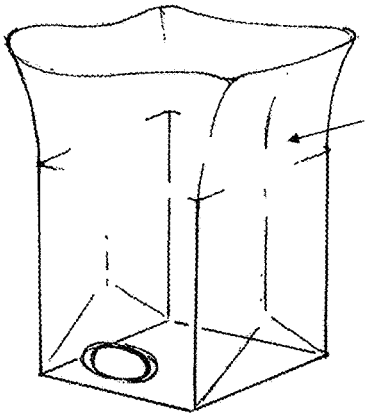
FIG. 6
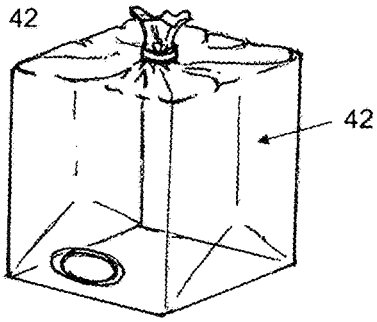
FIG. 5
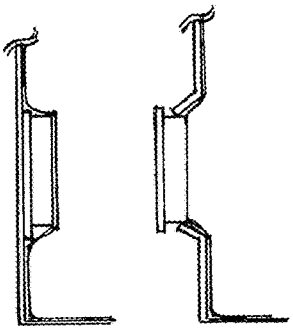
SPOUT-SIDE VIEW
PERF-SEALED PERF-OPENED
FIG. 9A FIG. 9B 100
110
136
134

112

110
132
112
124
126
130
114

120
128
122
112

120
128
112

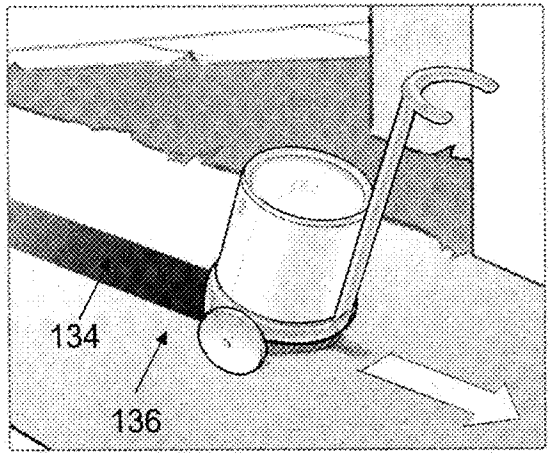
FIG. 15
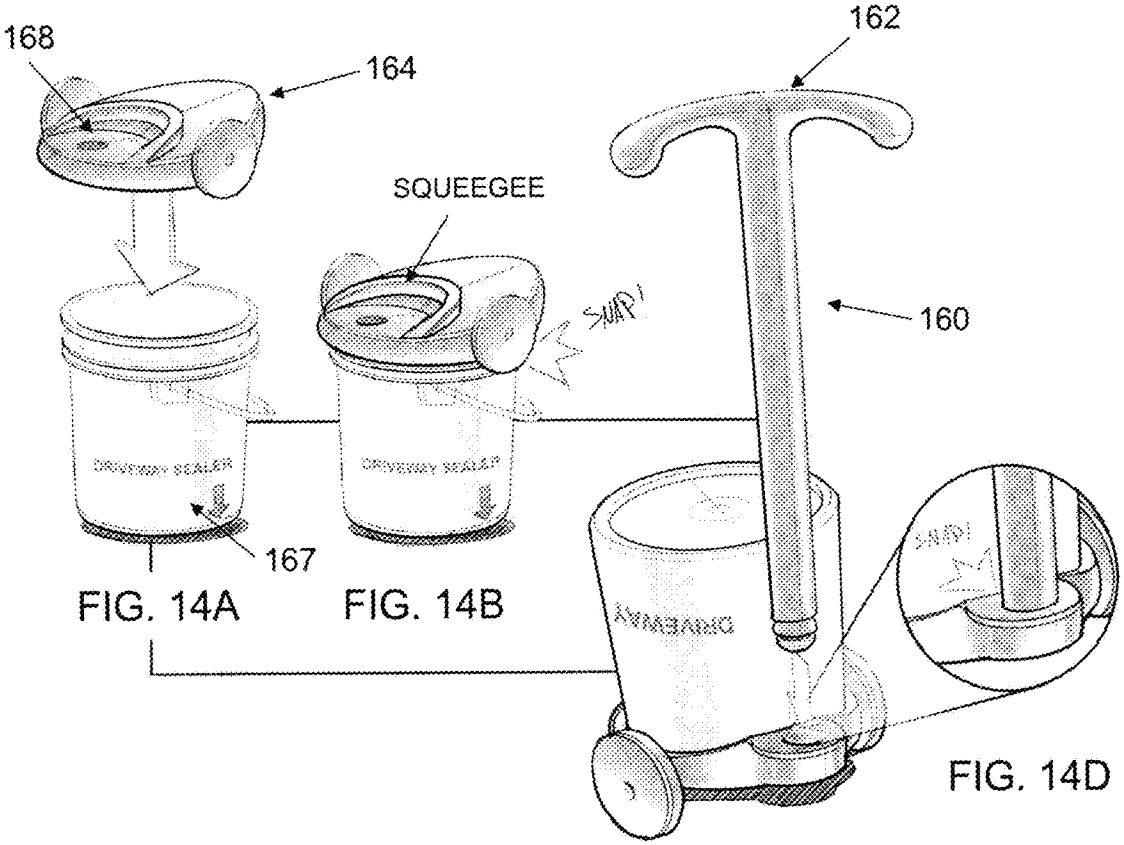
FIG. 14A
FIG. 14B
FIG. 14C
FIG. 14D

PACKAGING FOR DRIVEWAY SEALERS AND REPAIR MATERIALS

RELATED APPLICATIONS

The present inventing claims the benefit of U.S. Provisional Application 62/383,656 filed on Sep. 6, 2016 and U.S. Provisional Application 62/409,396 filed on Oct. 18, 2016, both of which are incorporated by reference as if fully rewritten herein.

BACKGROUND OF THE INVENTION

1. Field of the Invention

The present invention relates to driveway sealer and repair materials and, more particularly, to an improved packaging and handling method for use therewith.

2. Description of the Related Art

Hardware stores, DIY/home improvement stores or those retailers that sell construction materials generally have a product category referred to as "driveway sealers and repair", "concrete, cement and masonry", or "concrete sealers and repair", or similar. This category includes a variety of materials for sealing or repairing concrete or asphalt surfaces. Such materials are generally asphalt based, cement base or acrylic or polymeric based building materials.

While the properties, features or benefits of these variety of materials may vary, the distribution, sale and use of these products generally encounter some universal problems. They are heavy. They are difficult to handle and dispense by the end user. They are difficult to easily stock and display by the retailer. Their distribution range is limited due to weight, packaging and freight limitations. And, due to the chemical and/or physical properties the choice of any packaging materials may be functionally limited.

By way of example, and not meant as a limitation, one typical acrylic based driveway sealer product is shown in FIG. 1 according to the PRIOR ART. As shown in FIG. 1, the product, designed as an asphalt driveway sealer, is distributed, displayed, sold in and dispensed from a 4 or 5 gallon plastic bucket. As asphalt ages is oxidizes and dries, leading to cracks that can facilitate water intrusion. Water intrusion, plus freezing and thawing cycles, inevitably lead to damage that can be result in catastrophic failure of the asphalt. Rather than replacement of a driveway on regular intervals, a typical driveway sealer of the PRIOR ART such as that shown in FIG. 1 is intended to be applied over top of the asphalt in order to seal and prevent water intrusion to begin with.

Such products are typically heavy liquids that need to be rolled (with a paint roller) or squeegeed (with a dedicated squeegee device) onto a target surface, where it dries forming a protective barrier. Further, since a 5 gallon amount only covers between 600 sq. ft to 800 sq. ft of surface, and driveways can be significantly larger than that, a consumer must purchase multiple 5 gallon buckets to complete a single application. For example, one retailer, Home Depot®, regularly offers as a purchasing unit a pallet of 36 buckets/pails of such material.

This example is meant to typify common problems associate with many, if not all products related to this category. These products vary widely in formulation depending upon manufacturer and depending upon the particular end use application for which they are intended. However, to date the best options achieved commercially for packaging that can be used conveniently from filling through distribution to end use has been a 5 gallon plastic bucket.

The use of 5 gallon plastic buckets for use with asphalt or concrete based building repair materials leave many areas of improvement. Such buckets are expensive. Such buckets are difficult from which to dispense the product. Such buckets create weight and stacking packing density limitations when distributed or handled in volume.

It is preferable that packaging for driveway sealers and repair materials be less expensive and lighter weight that conventional plastic buckets. It also preferable that such packaging be easy to handle during transport and while dispensing. It is further preferably that such packaging allow for maximum packing density during shipping and storage. And, it is further preferable that when the use of such packaging is concluded that it provide for a reduced amount of land-fillable waste, as compared with conventional plastic buckets.

Consequently, a need has been felt for providing an improved packaging and handling method for use with driveway sealers and repair materials and the like.

SUMMARY OF THE INVENTION

It is thus an object of the present invention to provide an improved packaging and handling method to replace the use of conventional 5 gallon buckets.

Briefly described according to a preferred embodiment of the present invention, a packaging system is provided comprising essentially: a cube shaped outer corrugated cardboard housing; and, a high temperature stable, sealing insert. The sealing insert may comprises a gusseted bag insert. Additionally, a a blow-molded support insert may be provided in conjunction with the bag insert. The blow molded insert is form six intersecting sidewalls designed of a thermoplastic polymer that is stable to chemical and temperature conditions of the contents. The insert forms a storage volume and includes at least to orifices: a filling spout; and a dispensing spout. The filling spout is intended to be positioned at the uppermost sidewall. A dispensing spout may be positioned at any other sidewall. The insert is placed within a high temperate stable polymeric gusseted bag insert and provides a shaping structure for maintaining a cubic volume therein. The bag/insert combination is then stored fittingly within the cube shaped, corrugated cardboard outer housing. The outer housing further incorporates structural support, handling, dispensing and stacking features.

It is an advantage of the present invention to provide a packaging system that is smaller than an otherwise conventional plastic bucket.

It is another advantage of the present invention to provide a packaging system that is easier to handle, use and manipulate than an otherwise conventional plastic bucket.

It is yet anther advantage of the present invention to provide a dispensing spout to allow for easier application of the product contents.

It is a further advantage of the present invention to allow for oval, square or rectangular shaped spout to allow for patterned dispensing.

It is a further advantage of the present invention to provide a packaging system that can stand up to petroleum based products over an extended shelf life.

It is a further advantage of the present invention to provide a packaging system that can stand up to products that require filling at elevated temperatures.

It is yet a further advantage of the present invention to provide packaging that can stack and stip in a more efficient manner.

It is still a further advantage of the present invention to provide a packaging system that results in a reduced amount of packaging material that can also be recycled or partially recycled.

Further features of the invention will become apparent in the course of the following description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

FIG. 5 is a front perspective view of a sealing insert 40 for use therewith;

FIG. 6 is a front perspective view of the sealing insert 40 of FIG. 4 shown having a bag sealer 42 in an open configuration;

FIG. 7 is a front perspective view of a bag sealer insert 44 for use therewith to form an internal supported volume;

FIG. 8 is a front perspective view of the bag sealer insert 44 of FIG. 6 shown in a collapsed configuration for use in nested packaging for shipping;

FIG. 9A is a side cross sectional view of a spout assembly shown in a retracted, storage configuration;

FIG. 9B is a side cross sectional view of a spout assembly shown in an extended, dispensing configuration;

FIG. 14*a* through FIG. 14*d* depict an asphalt sealer packaging and dispensing system according to a fourth alternate embodiment of the present invention; and FIG. 15 is a perspective view thereof shown in use.

DESCRIPTION OF THE PREFERRED EMBODIMENTS

Figure 1:
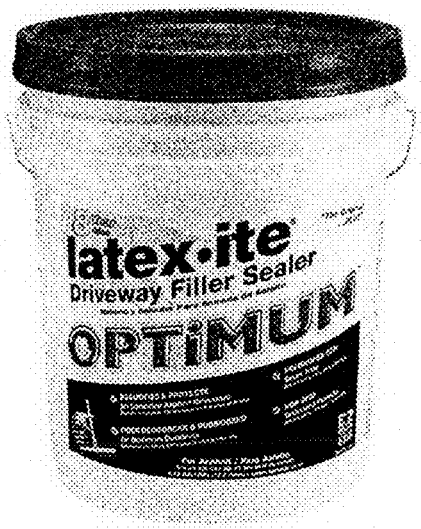
PRIOR ART FIG. 1
FIG. 1 shows a typical acrylic based driveway sealer product according to the PRIOR ART packaged in a conventional plastic bucket.

The best mode for carrying out the invention is presented in terms of its preferred embodiment, herein depicted within the Figures. It should be understood that the legal scope of the description is defined by the words of the claims set forth at the end of this patent and that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

It should also be understood that, unless a term is expressly defined in this patent there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

The best mode for carrying out the invention is presented in terms of its preferred embodiment, herein depicted within the Figures.

1. Detailed Description of the Figures

Referring now to the drawings, wherein like reference numerals indicate the same parts throughout the several views, a packaging system, generally noted as 10, is provided according to the preferred embodiment of the present invention. The packaging system 10 comprising essentially: a cube shaped outer corrugated cardboard housing 20; and, a high temperature stable, sealing insert 40.

Figure 2:
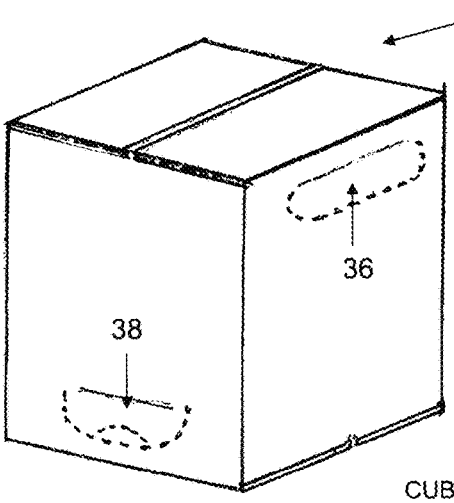
FIG. 2 depicts a front perspective view of a packaging system according to a preferred embodiment of the present invention.
Figure 3:
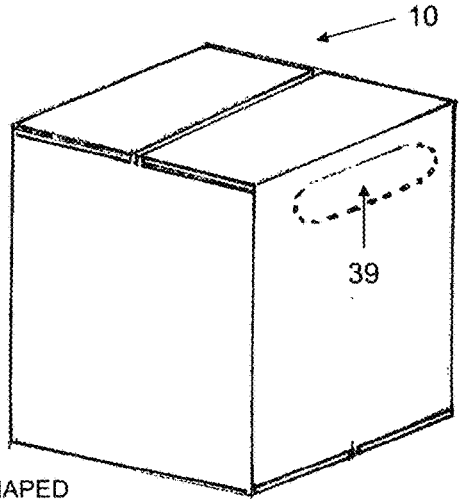
FIG. 3 is a rear perspective view thereof.
Figure 4:
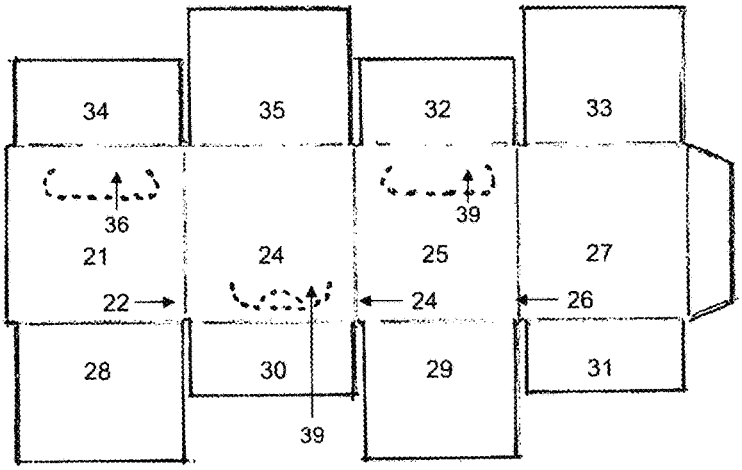
FIG. 4 is a layout view of a blank from which an outer container housing 20 is formed embodying the invention may be erected, showing the outside surface thereof and illustrating its relationship between adjacent panel elements.
Figures 10A, 10B, 10C, 10D, 11:
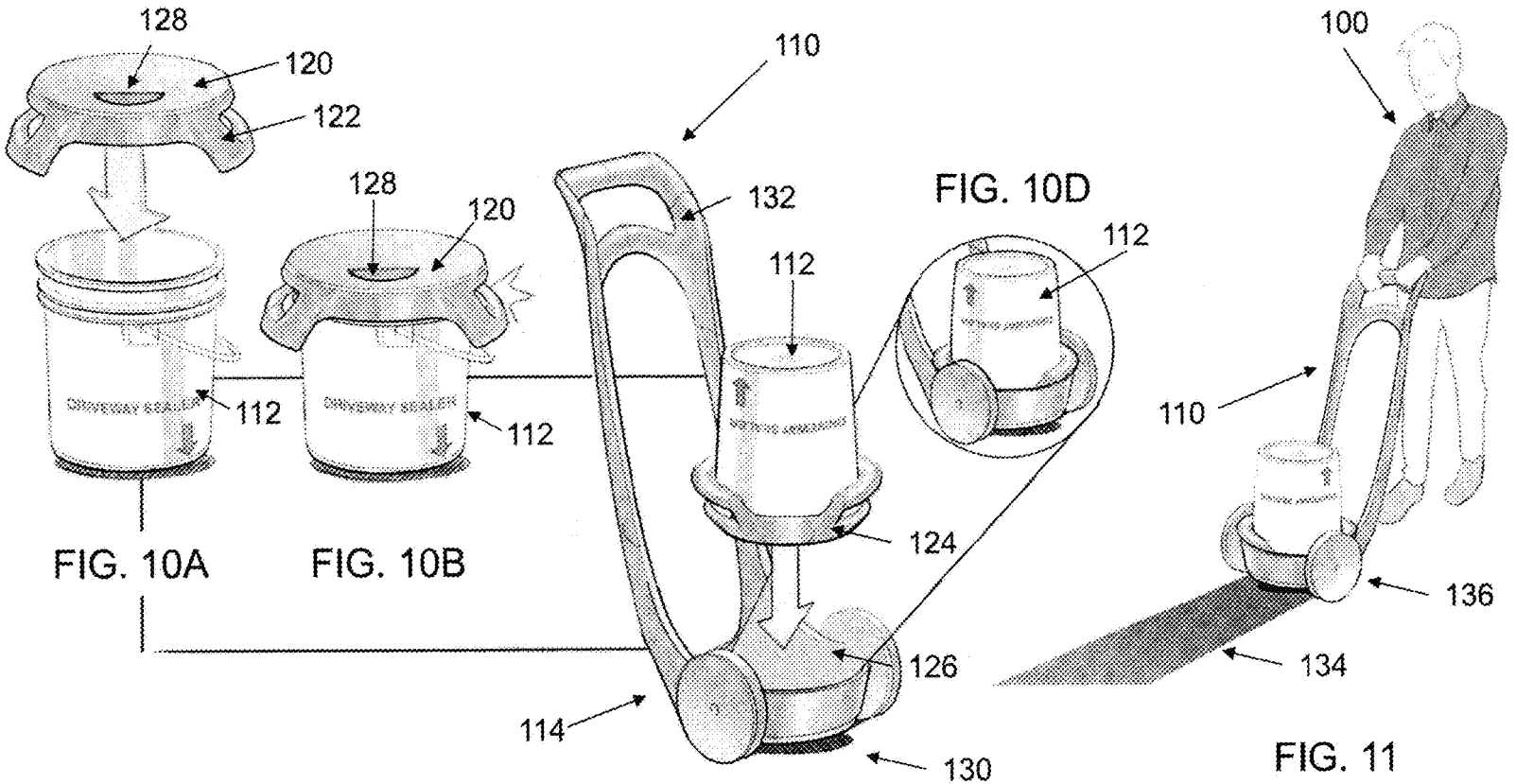
FIG. 10*a* through FIG. 10*d* depict an asphalt sealer packaging and dispensing system according to a second preferred embodiment of the present invention.
FIG. 11 is a perspective view thereof shown in use.

As shown in conjunction with FIG. 2 through FIG. 4, the outer housing 20 is intended to be formed of a cube shape. Intended to be formed of corrugated cardboard, the outer housing 20. Conventionally, the most common box styles are the Regular Slotted Container (RSC), where all flaps are the same length from score to edge. With such containers the major flaps typically meet in the middle and the minor flaps do not.

In contrast, the blank from which an outer container housing 20 is formed (FIG. 4) has a different configuration, including:

a first front side panel 21 having a first score line 22 adjacent to a front panel 23;

a second side panel 25 having a second score line 24 adjacent to a the front panel 23 and a third score line 26 adjacent to a rear panel 27;

a first bottom support flap 28 extending a majority of the way across a bottom surface;

a second bottom support flap 29 also extending a majority of the way across a bottom surface;

a first bottom closure flap 30 and a second bottom closure flap 31 configured meet in the middle of a bottom surface;

a first top support flap 32 extending a majority of the way across a top surface;

a second top support flap 33 also extending a majority of the way across a top surface;

a first top closure flap 34 and a second top closure flap 35 configured meet in the middle of a top surface; and a sealing tab or flap 37 for glued attachment to the first side panel 21.

Additionally, the outer housing 20 has formed a first handhold perforation 36 formed in the first side panel 31 and a second handhold perforation 37 formed in the second side panel 25. These handholds 36, 37 are formed as elongated oval perforated slots in the corrugated sidewall 20. These, in combination with the regular cube shape, provide both an efficient packing weight density for shipping as well as handling and use by the consumer. Further still, a dispensing spout access orifice 38 is formed as a perforated flap to allow access to a dispensing spout as will be described in greater detail below.

Referring now in conjunction with FIGS. 5-6, the sealing insert 40 is shown in greater detail. According to one aspect of the present invention, the sealing insert 40 may comprises a gusseted bag insert 42. Additionally, according to another aspect of the present invention, the sealing insert 40 may comprise the gusseted bag insert 42 in combination with a blow-molded support insert 44 may be provided in conjunction with the bag insert. The blow molded insert 44 is nested in and contained by the bag insert 42 and provides a structured volume within the sealing insert 40.

As shown in conjunction with FIG. 7, the blow molded insert 44 is formed of six intersecting sidewalls designed of a thermoplastic polymer that is stable to chemical and temperature conditions of the contents. The insert 44 forms a storage volume and includes at least to orifices: a filling spout 46; and a dispensing spout 48. The filling spout 46 is intended to be positioned at the uppermost sidewall. A dispensing spout 48 may be positioned at any other sidewall.

As shown in conjunction with FIG. 8, the insert 44 is shown in a collapsed configuration. It is an intended aspect of the present invention that the insert 44 be collapsible in a structured, targeted manner such as to allow for the component to be nested when a plurality of such elements are packaged from the component manufacturer. Such nesting creates efficiency in shipping from a blow molder to a packing/filling facility. Further, such collapsible nautre of the insert 44 can aid in breaking down the packaging elements upon completion by the user and in preparation for recycling or disposal.

Finally, according to another aspect of the present invention, either or both the filling spout 46 and dispensing spout 48 are intended to be capable of being retracted (as shown in FIG. 9A) for storage within the packaging 10, or extended (as shown in FIG. 9B) when the respective spout needs to be accessed.

It is intended that various other aspects of the present invention may include other features to allow for easy dispensing of product for use from the packaging material. By way of one exemplary use, and not meant as a limitation, when a consumer is currently dispensing driveway sealer from a 5 gallon plastic bucket they are required to spill a small amount of material at a time by tipping the bucket, and then rolling or squeegeeing the material about a partial coverage area. This process is repeated. However, this process is far from precise, and can cause mess or undesired overpour, especially at the beginning when the 5 gallon bucket is full and has an initial weight of 40, 50 or more pounds. In such use, the present invention not only includes a dispensing spout 48 that can be used to control liquid dispensing, but may include other features to allow additional control of an amount of dispensing pattern of material. These may include valving mechanism or various geometry spout cross sections (e.g. oval, square, etc.) to allow for a more accurate controlled dispensing of either volume, or pattern, or both.

Referring now to FIG. 10*a* through FIG. 10*d*, wherein like reference numerals indicate the same parts throughout the several views, an asphalt sealer packaging and dispensing system, generally noted as 110, is provided according to a first alternate embodiment of the present invention. The system 110 comprising essentially: a pre-portioned, modular containment 112 for containing a volume cold pour asphalt sealer is a modular, interchangeable manner; and, a spreading apparatus 114. As shown in this preferred embodiment, the containment 112 may form a generally cylindrical, plastic bucket housing. While it is understood that the bucket 112 may be provided as part of an overall system or kit, it is further envisioned that a general equivalent of the present invention may be expanded to include the use of those existing pre-filled buckets of material similar to those shown or anticipated by FIG. 1. In either a variant, as sealing lid 120 is affixed about an upper opening of the bucket 112. In the variation that the containment 112 is provided as part of an overall system, the sealing lid 120 may be provided already attached to the bucket 122; in the variant that existing pre-filled bucket of product are to be used, the sealing lid 112 may be attached to the bucket 112 after removal of the factory provided lid (not shown).

As described in greater detail, the sealing lid 120 connects about an upper opening of the bucket 112. A plurality of timing connectors 122, shown herein as tabbed locking flanges, provide for both a lifting handle 124 as well as a locking mechanism for attachment into the spreading apparatus 114. As shown in conjunction with FIG.10*c* and FIG.10*d*, the bucket 112 with sealing lid 120 attached may be inverted and then snapped into position within a receiving chamber 126 of the spreading apparatus 114. A discharge orifice 128 further formed in the lid 120 will thereby allow for dispensing of product in a controlled manner. As shown in conjunction with FIG. 11, with the spreading apparatus 114 including a wheeled carriage 130 with grasping/pushing handles 132, a linear output of product 134 may be applied onto a target surface 136 in a simple, easy to control motion by a user 100.

Figures 12A, 12B, 13:
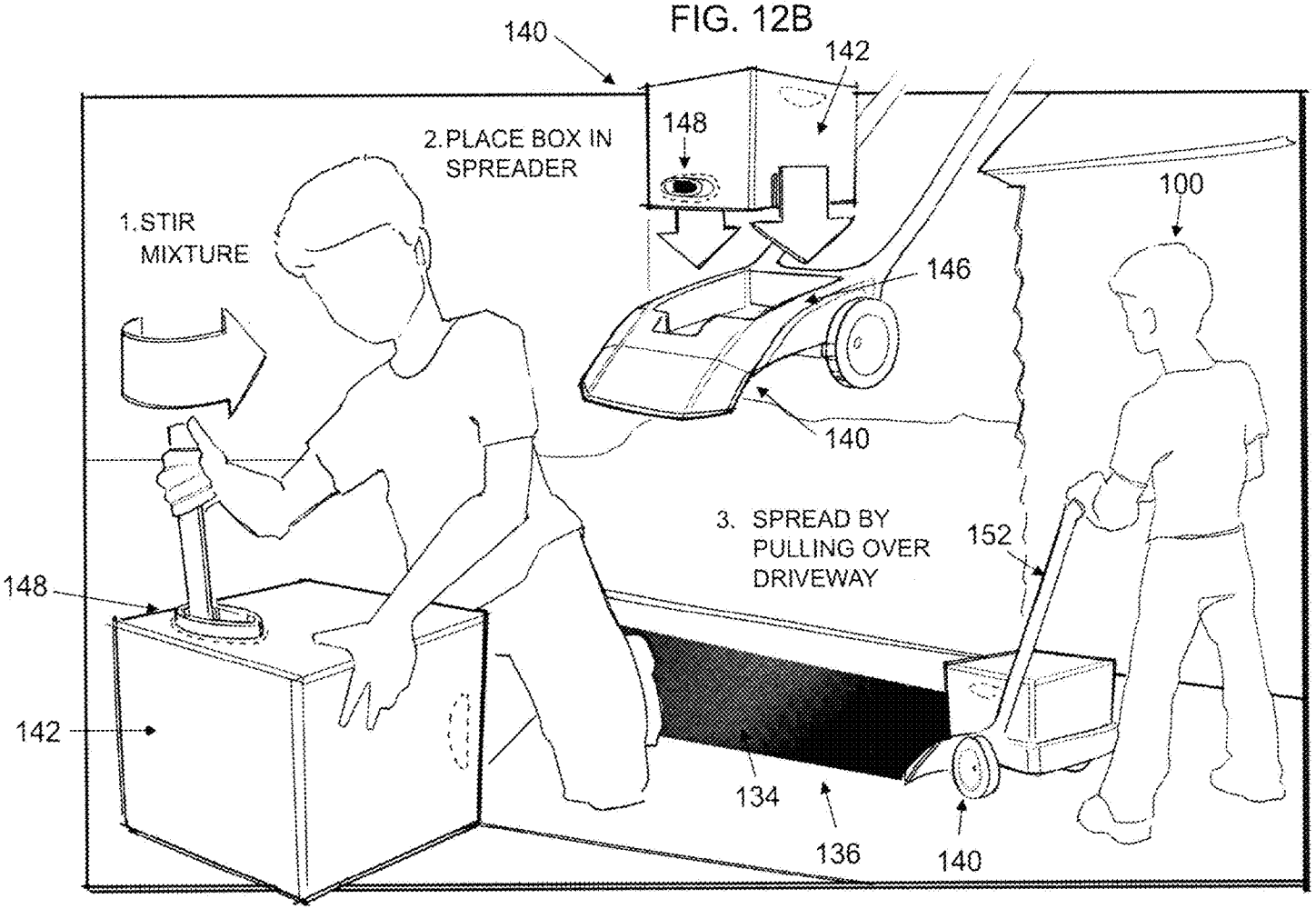
FIG. 12*a* through FIG. 12*b* depict an asphalt sealer packaging and dispensing system according to a third alternate embodiment of the present invention.
FIG. 13 is a perspective view thereof shown in use.

Referring now to FIG. 12*a* and FIG. 12*b*, an asphalt sealer packaging and dispensing system, generally noted as 140, is provided according to a second alternate embodiment of the present invention. The system 140 similarly comprises essentially: a pre-portioned, modular containment 142 for containing a volume cold pour asphalt sealer is a modular, interchangeable manner; and, a spreading apparatus 144. As shown in this first alternate embodiment, the containment 142 may form the improved packaging, handling and dispensing method for concrete or asphalt sealing materials or the like as disclosed in the Related Art, and incorporated by reference as if fully rewritten herein. Such a cube shaped corrugated cardboard housing can then be prepared by stirring the contents (FIG. 12*a*) and placing the box housing 142 within a spreading apparatus 144. A discharge orifice 148 will thereby allow for dispensing of product in a controlled manner. As shown in conjunction with FIG. 13, with the spreading apparatus 140 including a wheeled carriage 146 with grasping/pushing handles 152, a linear output of product 134 may be applied onto a target surface 136 in a simple, easy to control motion by a user 100.

Referring now to FIG. 14*a* through FIG. 14*d*, an asphalt sealer packaging and dispensing system, generally noted as 160, is provided according to a third alternate embodiment of the present invention. The system 160 similarly comprises essentially: a pre-portioned, modular containment 162 for containing a volume cold pour asphalt sealer is a modular, interchangeable manner; and, a spreading apparatus 164. As shown in this second alternate embodiment is a design variation of the preferred embodiment shown in FIG. 10*a* through 10*d*, but the improvement of incorporating the wheeled carriage as an integrated part of the sealing lid. A discharge orifice 168 will thereby allow for dispensing of product in a controlled manner. As shown in conjunction with FIG. 15, with the spreading apparatus 160 including a wheeled carriage 164 with grasping/pushing handles 162, a linear output of product 134 may be applied onto a target surface 136 in a simple, easy to control motion by a user.

As shown, described and taught in the present disclosure, the improved packaging fulfills long felt and yet unfilled needs in the handling, shipping, transport, and dispensing of certain building and maintenance materials. These include driveway sealers and repair materials and the like. However, one skilled in a relative art, in light of the present invention, may see further use extensions with other materials, such a paint, coatings, or as yet unidentified materials that are sold in a bulk, liquid, heavy manner that require dispensing for application or use.

2. Operation of the Preferred Embodiment

The intended operation of the present invention is to replace the use of otherwise conventional 4 or 5 gallon plastic buckets for the transport, manipulation and dispensing of contained product. To this end, the form shaping insert 144 may be placed within a high temperate stable polymeric gusseted bag insert 142, and then inserted into an assembled corrugated cardboard outer housing 120. The bag/insert combination is then stored fittingly within the cube shaped, corrugated cardboard outer housing. The insert 144 may then be filled with liquid contents through the filling spout 146. Given that asphalt based materials are thermoplastic (i.e. softens as it warms, and stiffens as it cools), these are processed at elevated temperatures and will be filling within the packaging system 110 at temperatures up to or exceeding 150 ° F. As such, the blow molded insert 144 and gusseted bag sealer 142 must be made of high temperature stable materials that can withstand contact with such materials and at such temperatures.

One filed, the cubic cardboard outer housing functions as a very efficient packaging system, providing maximum packing density for shipping and transport, as well as ease of handling by the end consumer.

In operation, a consumer would merely transport the cubic packaging system to a jobsite (with hand truck or manually carrying via the handle holds of the sidewalls), and placed near a desired dispensing area. The user then may dispense application amounts of product in a targeted manner for use, with dispensing being in a more controlled manner than is otherwise obtainable with conventional plastic buckets.

The foregoing descriptions of specific embodiments of the present invention are presented for purposes of illustration and description. They are not intended to be exhaustive nor to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications as are suited to the particular use contemplated. It is intended that a scope of the invention be defied broadly by the Drawings and Specification appended hereto and to their equivalents. Therefore, the scope of the invention is in no way to be limited only by any adverse inference under the rulings of *Warner-Jenkinson Company,* v. *Hilton Davis Chemical*, 520 U.S. 17 (1997) or *Festo Corp.* v. *Shoketsu Kinzoku Kogyo Kabushiki Co.*, 535 U.S. 722 (2002), or other similar case-law or subsequent precedent should not be made if any future claims are added or amended subsequent to this Patent Application.

What is claimed is:

1. An asphalt sealer packaging and dispensing system comprising:

a pre-portioned, modular containment for containing a volume of cold pour asphalt sealer in a modular, interchangeable manner;

an ambulating spreading apparatus in fluid communication with said volume and adapted for gravity-fed dispensing of said asphalt sealer directly from said modular containment to a surface to be sealed;

an outer housing formed in a hexahedron of corrugated cardboard;

a sealing insert comprising a gusseted bag insert nested in and contained by the modular containment;

a support insert nested in and contained by the bag insert and adapted to provide a structured volume within the sealing insert;

a filling spout in fluid communication between the asphalt sealer, through said sealing insert and extending upward through a filling spout access orifice formed in said outer housing; and a dispensing spout in fluid communication between the asphalt sealer, through said sealing insert and extending outward from a dispensing spout access orifice formed as a hinged perforated flap in said outer housing.

2. The asphalt sealer packaging and dispensing system of claim 1, wherein said outer housing further comprises:

a first front side panel having a first score line adjacent to a front panel;

a second side panel having a second score line adjacent to a the front panel and a third score line adjacent to a rear panel;

a first bottom support flap extending across a majority of a bottom surface;

a second bottom support flap extending across a majority of the bottom surface;

a first bottom closure flap and a second bottom closure flap configured meet at a middle of the bottom surface;

a first top support flap extending across a majority of a top surface;

a second top support flap extending across a majority of the top surface;

a first top closure flap and a second top closure flap configured meet at a middle of the top surface; and a sealing tab or flap for glued attachment to the first side panel.

3. The asphalt sealer packaging and dispensing system of claim 1, wherein said outer housing further comprises:

a first handhold perforation formed in a first side panel as an elongated oval perforated slots in the corrugated sidewall; and a second handhold perforation formed in a second side panel as an elongated oval perforated slots in the corrugated sidewall.

4. The asphalt sealer packaging and dispensing system of claim 2, wherein said outer housing further comprises:

a first handhold perforation formed in the first side panel as an elongated oval perforated slot in the corrugated sidewall; and a second handhold perforation formed in the second side panel as an elongated oval perforated slot in the corrugated sidewall.

5. The asphalt sealer packaging and dispensing system of claim 1, wherein said support insert comprises:

a molded plastic body formed of six intersecting sidewall and demarcating a storage volume;

a filling spout orifice formed at an uppermost sidewall; and a dispensing spout formed at any other sidewall.

6. The asphalt sealer packaging and dispensing system of claim 5, wherein said molded plastic body is formed of a thermoplastic or thermoset polymer that is stable to chemical and temperature conditions of the asphalt sealer.

7. The asphalt sealer packaging and dispensing system of claim 1, wherein said outer housing is adapted to adjust to a collapsed configuration when not in use so as to allow for plurality of outer housings to be stacked; and said support insert is adapted to nested with a plurality of such support inserts when not in use.

8. The asphalt sealer packaging and dispensing system of claim 1, wherein said filling spout is capable of being retracted for storage within the outer housing; and said dispensing spout is capable of being retracted for storage within the outer housing.

9. The asphalt sealer packaging and dispensing system of claim 1, said spreading apparatus further comprises:

a wheeled carriage with grasping/pushing handles.

10. The asphalt sealer packaging and dispensing system of claim 1, said spreading apparatus further comprises:

a wheeled carriage with grasping/pushing handles; and said dispensing spout adapted to dispense a linear output of asphalt sealer as said wheeled carriage is rolled along a target surface.

11. The asphalt sealer packaging and dispensing system of claim 5, said spreading apparatus further comprises:

a wheeled carriage with grasping/pushing handles; and said dispensing spout adapted to dispense a linear output of asphalt sealer as said wheeled carriage is rolled along a target surface.

12. The asphalt sealer packaging and dispensing system of claim 8, said spreading apparatus further comprises:

a wheeled carriage with grasping/pushing handles; and said dispensing spout adapted to dispense a linear output of asphalt sealer as said wheeled carriage is rolled along a target surface.

13. An asphalt sealer packaging and dispensing system, comprising:

a pre-portioned, modular containment for containing a volume of cold pour asphalt sealer in a modular, interchangeable manner; and an ambulating spreading apparatus in fluid communication with said volume and adapted for gravity-fed dispensing of said asphalt sealer directly from said modular containment to a surface to be sealed, wherein said modular containment further comprises:

generally cylindrical, plastic bucket housing;

a sealing lid connectable about an upper opening of the bucket;

a locking mechanism for attachment into the spreading apparatus; and a lifting mechanism adapted to lift the plastic bucket while connected to said sealing lid; wherein said locking mechanism and said lifting mechanism are integrated as part of said sealing lid.

14. The asphalt sealer packaging and dispensing system of claim 13, wherein said locking mechanism is formed at an upper surface of said lid and encompasses a discharge orifice formed in said lid in a manner that the bucket with sealing lid attached, when inverted, is connected into a position within a receiving chamber of the spreading apparatus.

15. The asphalt sealer packaging and dispensing system of claim 13, said spreading apparatus further comprises:

a wheeled carriage with grasping/pushing handles; and said dispensing spout adapted to dispense a linear output of asphalt sealer as said wheeled carriage is rolled along a target surface.

16. The asphalt sealer packaging and dispensing system of claim 14, said spreading apparatus further comprises:

a wheeled carriage with grasping/pushing handles; and said dispensing spout adapted to dispense a linear output of asphalt sealer as said wheeled carriage is rolled along a target surface.

* * * * *